US006773569B2

(12) United States Patent
Sun et al.

(10) Patent No.: US 6,773,569 B2
(45) Date of Patent: Aug. 10, 2004

(54) POTENTIAL PULSE-SCAN METHODS OF ANALYZING ORGANIC ADDITIVES IN PLATING BATHS WITH MULTI-COMPONENT ADDITIVES

(75) Inventors: Zhi-Wen Sun, San Jose, CA (US); Nicolay Kovarsky, Sunnyvale, CA (US); Chunman Yu, Sunnyvale, CA (US); Girish Dixit, San Jose, CA (US)

(73) Assignee: Applied Materials Inc., Santa Clara, CA (US)

( * ) Notice: Subject to any disclaimer, the term of this patent is extended or adjusted under 35 U.S.C. 154(b) by 117 days.

(21) Appl. No.: 10/142,719

(22) Filed: May 8, 2002

(65) Prior Publication Data

US 2003/0209440 A1 Nov. 13, 2003

(51) Int. Cl.[7] ..... C25D 21/12; C25D 5/00

(52) U.S. Cl. ..... 205/81; 205/82; 205/84; 204/228.6

(58) Field of Search ..... 205/81, 82, 84; 204/228.6

(56) References Cited

U.S. PATENT DOCUMENTS 4,132,605 A * 1/1979 Tench et al. ..... 205/787
5,223,118 A 6/1993 Sonnenberg et al.

OTHER PUBLICATIONS

Haak, et al., Cyclic Votammetric Stripping Analysis of Acid Copper Sulfate Plating Baths, Plating and Surface Finishing, Apr. 1981, ppg. 52–55.

Tench, et al., Cyclic Pulse Voltammetric Stripping Analysis of Acid Copper Plating Baths, Journal of Electrochemical Society, Apr. 1985, ppg. 831–833.

Tench, et al. A New Voltammetric Stripping Method Applied to the Determination of the Brightener Concentration in Copper Pyrophosphate Plating Baths, Journal of the Electrochemical Society, vol. 125, ppg 194–198, no date avail.

* cited by examiner

*Primary Examiner*—Wesley A. Nicolas
(74) *Attorney, Agent, or Firm*—Moser, Patterson, Sheridan

(57) ABSTRACT

A cyclic voltammetric method for measuring the concentration of additives in a plating solution. The method generally includes providing the plating solution, having an unknown concentration of an additive to be measured therein and cycling the potential of an inert working electrode through a series of measurement steps. The series of measurement steps includes a metal stripping step including pulsing from an open circuit potential to a metal stripping potential between about 0.2 V and about 0.8 V, and holding the metal stripping potential until a corresponding current nears 0 mA/cm. The series of measurement steps further includes a cleaning step including pulsing from the metal stripping potential to a cleaning potential between about 1.2 V and about 1.6 V, and holding the cleaning potential for about 2 seconds to about 10 seconds. The series of measurement steps then includes a pre-plating step including pulsing from the cleaning potential to a pre-plating potential between about −0.2 V and about −0.5 V, and holding the pre-plating potential for about 2 seconds to about 10 seconds. The series of measurement steps additionally includes an equilibration step including pulsing from the pre-plating potential to the open circuit potential, and holding the open circuit potential for a predetermined time period, and a metal deposition step including scanning from the open circuit potential of the equilibration step to an additive sensitive potential, holding the additive sensitive potential for about 1 second to about 30 seconds, and scanning back to the open circuit potential. The method further includes plotting a profile of a deposition current resulting from the metal deposition potential as a function of time and integrating the deposition current to determine the concentration of the additive to be measured.

46 Claims, 4 Drawing Sheets

POTENTIAL PULSE-SCAN METHODS OF ANALYZING ORGANIC ADDITIVES IN PLATING BATHS WITH MULTI-COMPONENT ADDITIVES

BACKGROUND OF THE INVENTION

1. Field of the Invention

Embodiments of the invention generally relate to analysis of plating solutions, and more particularly, to the analysis of additives in plating solutions.

2. Description of the Related Art

Metallization of sub-quarter micron sized features is a foundational technology for present and future generations of integrated circuit manufacturing processes. More particularly, in devices such as ultra large scale integration-type devices, i.e., devices having integrated circuits with more than a million logic gates, the multilevel interconnects that lie at the heart of these devices are generally formed by filling high aspect ratio interconnect features with a conductive material, such as copper or aluminum, for example. Conventionally, deposition techniques such as chemical vapor deposition (CVD) and physical vapor deposition (PVD) have been used to fill interconnect features. However, as interconnect sizes decrease and aspect ratios increase, efficient void-free interconnect feature fill via conventional deposition techniques becomes increasingly difficult. As a result thereof, plating techniques, such as electrochemical plating (ECP) and electroless plating, for example, have emerged as viable processes for filling sub-quarter micron sized high aspect ratio interconnect features in integrated circuit manufacturing processes.

In an ECP process, for example, sub-quarter micron sized high aspect ratio features formed into the surface of a substrate may be efficiently filled with a conductive material, such as copper, for example. ECP plating processes are generally two stage processes, wherein a seed layer is first formed over the surface and features of the substrate, and then the surface and features of the substrate are exposed to a plating solution, while an electrical bias is simultaneously applied between the substrate and an anode positioned within the plating solution. The plating solution is generally rich in ions to be plated onto the surface of the substrate, and therefore, the application of the electrical bias causes these ions to be urged out of the plating solution and to be plated onto the seed layer. Furthermore, the plating solution generally contains organic additives, such as, for example, levelers, suppressors, and accelerators that are configured to increase the efficiency and controllability of the plating process. These additives are generally maintained within narrow tolerances, so that the repeatability and controllability of the plating operation may be maintained and repeated.

Monitoring and/or determining the composition of a plating solution during an ECP process is problematic, as the depletion of certain additives is not necessarily constant over a period of time, nor is it always possible to correlate the plating solution composition with the plating solution use. As such, it is difficult to determine the concentration of additives in a plating solution with any degree of accuracy over time, as the level of additives may either decrease or increase during plating, and therefore, the additive concentrations may eventually exceed or fall below the tolerance range for optimal and controllable plating. Conventional ECP systems generally utilize a cyclic voltammetric stripping (CVS) or a cyclic pulse voltammetric stripping (CPVS) process to determine the organic additive concentrations in the plating solution. In a CVS process, for example, the potential of a working electrode is swept through a voltammetric cycle that includes both a metal plating range and a metal stripping range. The potential of the working electrode is swept through at least two baths of non-plating quality, and an additional bath where the quality or concentration of organic additives therein is unknown. In this process, an integrated or peak current used during the metal stripping range may be correlated with the quality, i.e., concentration of additives, of the non-plating bath. As such, an integrated or peak current may be compared to the correlation of the non-plating bath, and the quality of the unknown plating bath determined therefrom. The amount of metal deposited during the metal plating cycle and then redissolved into the plating bath during the metal stripping cycle generally correlates to the concentration of particular organics, generally brighteners or accelerators, in the plating solution. Therefore, CVS methods generally observe the current density of the copper ions reduced on an electrode at a predetermined potential. Inasmuch as accelerators and brighteners increase the current density, the quantity of both may be determined from the observation.

However, one challenge associated with utilizing conventional CVS methods for determining the concentration of organics in a plating solution is that by-products, such as organic contaminants generated in plating processes, may interfere with the analysis process. More particularly, by-products essentially compete with additives for adsorption sites in certain potential ranges, and therefore, if the analysis scanning range includes the by-product adsorption range, the analysis of the unknown additive concentration may be affected by the adsorption of the by-products. Furthermore, the effect of the by-products on the additive analysis is amplified at higher working electrode rotation rates because the by-products and additives diffuse at a faster rate. Another challenge associated with conventional CVS methods is that a wide potential scanning range generally is used to ensure analysis reproducibility, thereby resulting in a relatively long time between analysis and correction.

CPVS processes attempt to overcome the challenges of conventional CVS processes by sequentially pulsing the working electrode between metal plating, stripping, cleaning, and equilibration steps to maintain the working electrode surface in a relatively clean and reproducible condition. CPVS generally avoids the by-product adsorption potential range by pulsing to the known additive adsorption potential range, i.e., by moving directly from an open circuit potential to a potential within the additive adsorption range without scanning through the by-product adsorption range. The steady-state charge density corresponding to the stripping step is then proportional to the additive concentration.

However, CPVS is not without challenges. For example, CPVS generally does not provide control over the rate of the forward reaction for metal deposition. Therefore, separation of interference is difficult. Due to the strong interaction among multiple additives competing for working electrode surface adsorption sites, the analysis of any one single additive may suffer from the interference of the other additives. As such, there is a need for a method for measuring additives in a plating solution, wherein the method is not susceptible to the inaccuracies of conventional analysis processes.

SUMMARY OF THE INVENTION

Embodiments of the invention generally relate to a cyclic voltammetric method for measuring the concentration of additives in a plating solution. The method generally includes providing the plating solution having an unknown concentration of an additive to be measured therein, and cycling the potential of an inert working electrode in contact with the plating solution through a series of measurement steps. The series of measurement steps generally includes a metal stripping step, including pulsing from an open circuit potential to a metal stripping potential between about 0.2 V and about 0.8 V, and holding the metal stripping potential until a corresponding current is about 0 mA/cm. The series of measurement steps further includes a cleaning step including pulsing from the metal stripping potential to a cleaning potential between about 1.2 V and about 1.6 V, and holding the cleaning potential for about 2 seconds to about 10 seconds. The series of measurement steps then includes a pre-plating step including pulsing from the cleaning potential to a pre-plating potential between about −0.2 V and about −0.5 V, and holding the pre-plating potential for about 2 seconds to about 10 seconds. The series of measurement steps may additionally include an equilibration step including pulsing from the pre-plating potential to the open circuit potential and holding the open circuit potential for a predetermined period, and a metal deposition step including scanning from the open circuit potential of the equilibration step to an additive sensitive potential, holding the additive sensitive potential for about 1 second to about 30 seconds, and scanning back to the open circuit potential. The method may further include determining a profile of a deposition current resulting from the metal deposition potential as a function of time and integrating the deposition current to determine the concentration of the additive to be measured.

Embodiments of the invention further provide a method for measuring the concentration of additives in a plating solution. The method generally includes cycling the potential of an inert working electrode through a series of measurement steps. The series of measurement steps generally includes a metal stripping step including pulsing from an open circuit potential to a metal stripping potential sufficient to remove substantially all metal on the working electrode, and holding the metal stripping potential until a corresponding current nears 0 mA/cm. The series of measurement steps then includes a cleaning step including pulsing from the metal stripping potential to a cleaning potential and holding the cleaning potential for about 2 seconds to about 10 seconds. The series of measurement steps further includes a pre-plating step including pulsing from the cleaning potential to a pre-plating potential sufficient to plate a layer of metal on the working electrode, and holding the pre-plating potential for about 2 seconds to about 10 seconds, and an equilibration step including pulsing from the pre-plating potential to the open circuit potential, and holding the open circuit potential for a predetermined period. The series of measurement steps additionally includes a metal deposition step including scanning from the open circuit potential of the equilibration step to an additive sensitive potential, holding the additive sensitive potential for about 1 second to about 30 seconds, and scanning back to the open circuit potential. The method further includes determining a profile of a deposition current resulting from the metal deposition potential as a function of time and integrating the deposition current to determine the concentration of the additive to be measured.

Embodiments of the invention further provide a cyclic voltammetric method for measuring the concentration of additives in a plating solution. The method generally includes cycling the potential of an inert working electrode through a series of measurement steps. The series of measurement steps include a metal stripping step which includes pulsing from an open circuit potential to a metal stripping potential between about 0.4 V and about 0.6 V, and holding the metal stripping potential for about 2 seconds to about 10 seconds, and a cleaning step including pulsing from the metal stripping potential to a cleaning potential between about 1.2 V and about 1.6 V, and holding the cleaning potential for about 2 seconds to about 10 seconds. The series of measurement steps further includes a pre-plating step including pulsing from the cleaning potential to a pre-plating potential between about −0.2 V and about −0.5 V, and holding the pre-plating potential for about 2 seconds to about 10 seconds, and an equilibration step including pulsing from the pre-plating potential to the open circuit potential, and holding the open circuit potential for about 10 seconds to about 60 seconds. The series of measurement steps additionally includes a metal deposition step including scanning from the open circuit potential of the equilibration step to an additive sensitive potential, holding the additive sensitive potential for about 1 second to about 30 seconds, and scanning back to the open circuit potential. The method further includes repeating the series of measurement steps until steady state is reached, determining a profile of a deposition current resulting from the metal deposition potential as a function of time and integrating the deposition current to determine the concentration of the additive to be measured, and averaging the deposition currents from the series of measurement steps when steady state has been reached to determine the concentration of the additive to be measured.

Embodiments of the invention further provide a cyclic voltammetric method for measuring the concentration of additives in a plating solution. The method generally includes providing the plating solution having an unknown concentration of an additive to be measured therein and cycling the potential of an inert working electrode through a series of measurement steps. The series of measurement steps includes a metal stripping step including pulsing from an open circuit potential to a metal stripping potential between about 0.4 V and about 0.6 V, and holding the metal stripping potential for about 2 seconds to about 10 seconds, and a cleaning step including pulsing from the metal stripping potential to a cleaning potential between about 1.2 V and about 1.6 V, and holding the cleaning potential for about 2 seconds to about 10 seconds. The series of measurement steps further includes a pre-plating step including pulsing from the cleaning potential to a pre-plating potential between about −0.2 V and about −0.5 V and holding the pre-plating potential for about 2 seconds to about 10 seconds, and an equilibration step including pulsing from the pre-plating potential to the open circuit potential, and holding the open circuit potential for about 10 seconds to about 60 seconds. The series of measurement steps additionally includes a metal deposition step including scanning from the open circuit potential of the equilibration step to an additive desorption potential and holding the desorption potential for about 1 second to about 30 seconds, scanning to an additive adsorption potential and holding the adsorption potential for about 5 seconds to about 30 seconds, and scanning from the additive adsorption potential to the open circuit potential. The method further includes repeating the series of measurement steps until steady state is reached, determining a profile of a deposition current resulting from the metal deposition potential as a function of time and integrating the deposition current over the additive desorption potential to determine the concentration of the additive to be measured, and averaging the deposition currents from the series of measurement steps when steady state has been reached to determine the concentration of the additive to be measured.

Embodiments of the invention also provide a cyclic voltammetric method for measuring the concentration of additives in a plating solution. The method generally includes the step of cycling the potential of a working electrode through a series of measurement steps, comprising a metal stripping step, a cleaning step, a pre-plating step, an equilibration step, and a metal deposition step. The method also may include the step of determining a profile of a deposition current resulting from the metal deposition potential as a function of time and integrating the deposition current to determine the concentration of the additive to be measured.

BRIEF DESCRIPTION OF THE DRAWINGS

So that the manner in which the above recited features of the present invention can be understood in detail, a more particular description of the invention, briefly summarized above, may be had by reference to the embodiments thereof, which are illustrated in the appended drawings. It is to be noted, however, that the appended drawings illustrate only typical embodiments of this invention, and are therefore, not to be considered limiting of its scope, for the invention may admit to other equally effective embodiments.

DETAILED DESCRIPTION OF THE PREFERRED EMBODIMENT

Figure 1:
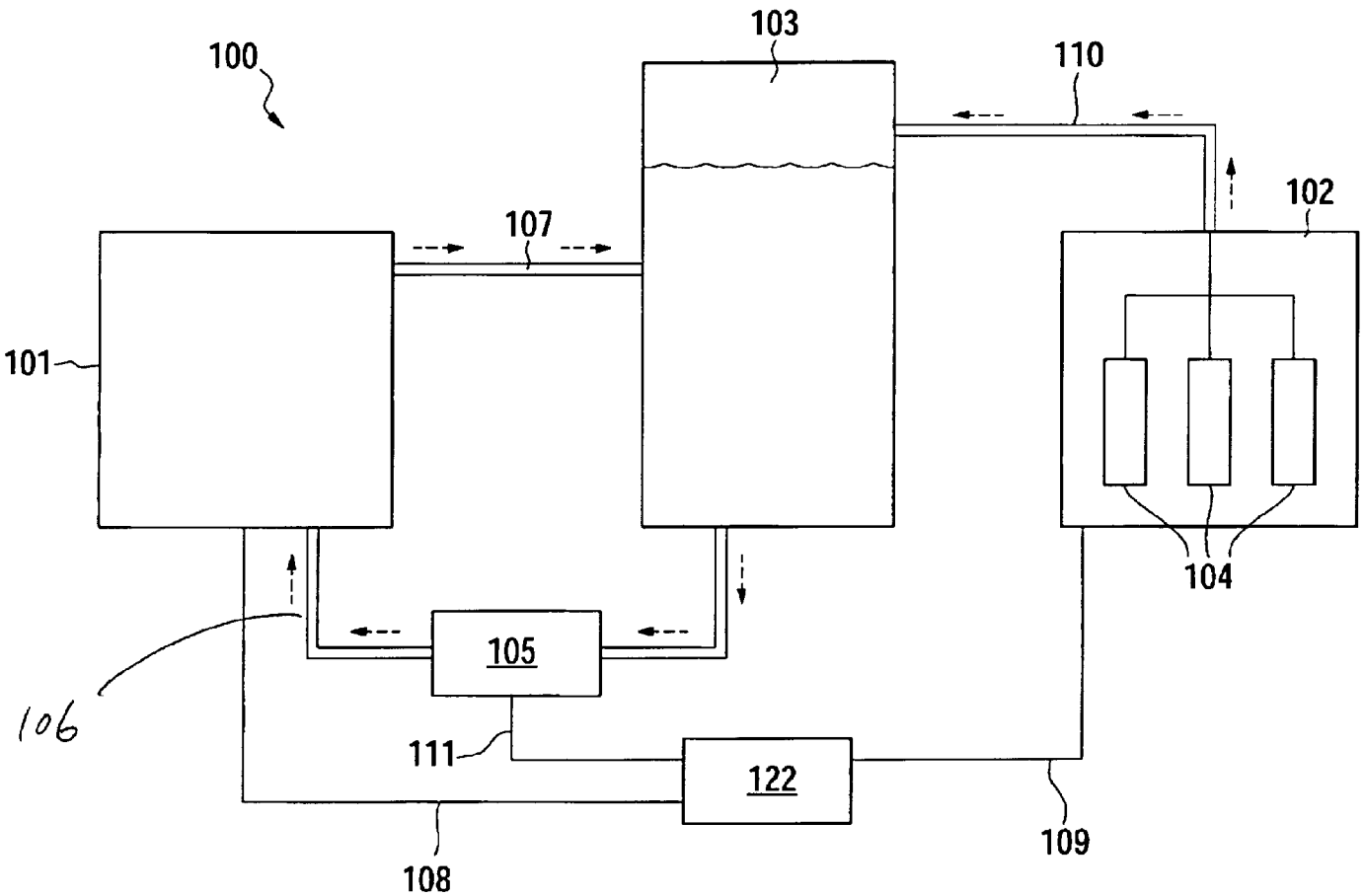
FIG. 1 is an exemplary embodiment of a plating system of the invention.

FIG. 1 illustrates an exemplary plating system 100 of the invention. The plating system 100 generally includes a plating cell 101, which may be, for example, an ECP plating cell configured to electrochemically plate copper onto a semiconductor substrate. The plating cell 101 may be selectively in fluid communication with a plating solution tank 103 configured to maintain a large volume of plating solution, approximately 200 liters, for example. The plating solution tank 103 may be configured to supply a plating solution stored therein to the plating cell 101 via a plating solution supply conduit 106 and return solution to tank 103 via a return conduit 107. The supply conduit 106 may be in fluid communication with a plating solution analysis device 105 configured to sample a portion of the plating solution flowing therethrough to determine the quantity of various components in the sampled portion of the plating solution. The plating system 100 may further include a chemical cabinet 102 having one or more chemical storage units 104 positioned therein or in fluid communication therewith. The chemical cabinet 102, and in particular, chemical storage units 104, may be selectively in fluid communication with the plating solution tank 103 via a chemical supply conduit 110.

Additionally, the plating system 100 may include a system controller 122, which may be a microprocessor-based controller, for example, configured to control the operation of the respective components of the plating system 100. The system controller 122 may be in electrical communication with the components of the plating cell 101 via an electrical conduit 108, with the components of the plating solution analysis device 105 via an electrical conduit 111, and with the components of chemical cabinet 102 via an electrical conduit 109. As such, the system controller 112 may receive inputs from the various components of plating system 100 and generate control signals that may be transmitted to the respective components of the plating system 100 for controlling the operation thereof. For example, the system controller 122 may be configured to control parameters such as the flow rate of plating solution into the plating cell 101, the timing and quantity of chemicals added to the plating solution by the chemical cabinet 102, and the operational characteristics of the plating cell 101, along with other parameters generally associated with ECP systems and ECP solution analysis.

Figure 2:
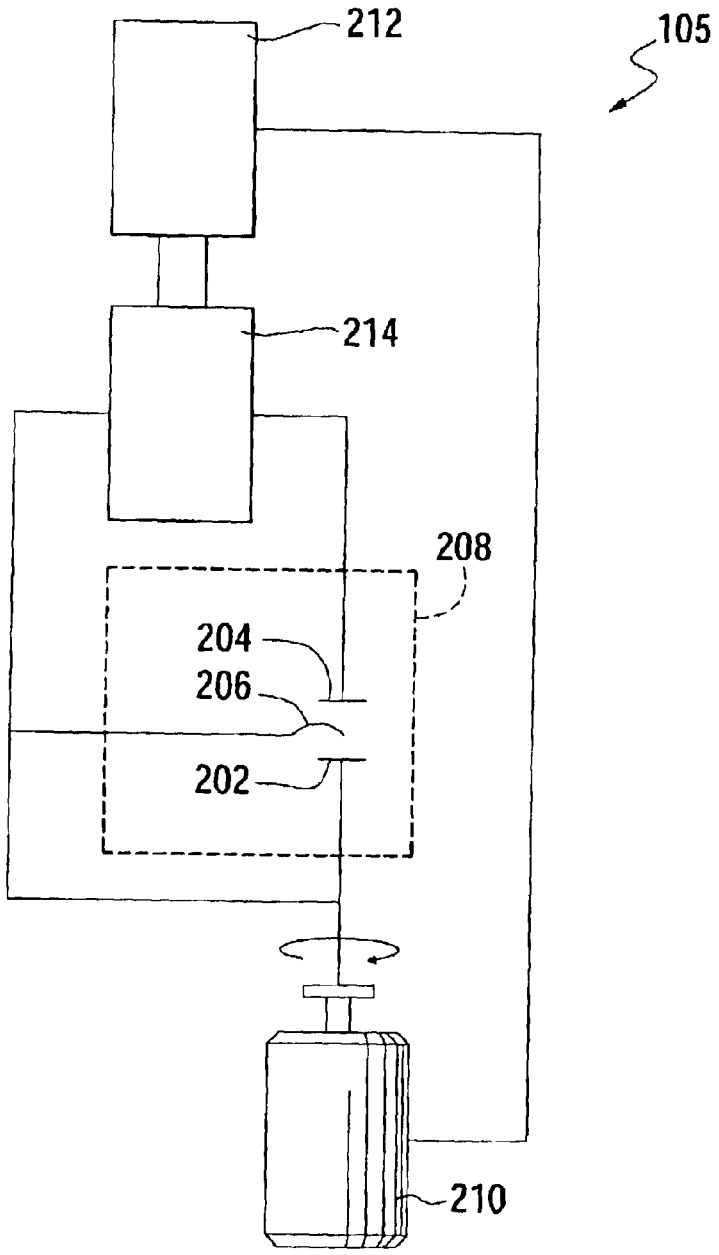
FIG. 2 is a cross section of a plating solution analysis device.

FIG. 2 illustrates a plating solution analysis device 105 useful in practicing the present invention. Three electrodes, a working electrode 202, a counter electrode 204, and a reference electrode 206, are generally immersed in a cell 208 having plating solution to be measured therein. The counter electrode 204 provides an internal standard which mitigates the effects of other plating solution constituents and changes in the state of the working electrode 202 surface. The counter electrode 204 is generally selected and designed so as not to be easily polarized in the particular plating solution being evaluated. This is accomplished, in part, by placing the counter electrode 204 close to the working electrode 202. The working electrode 202 is generally a metal disk, such as platinum, copper, nickel, chromium, zinc, tin, gold, silver, lead, cadmium, solder, glassy carbon, mercury, or stainless steel, for example. The working electrode 202 typically has a flat, polished surface, small diameter, and may be mounted flush with the end of a cylinder. A small diameter disk is generally preferred, since a larger diameter generally results in poor sensitivity due to non-uniform current density across the diameter. Other suitable working electrodes 202 include any electrode that provides a uniform current density and controlled agitation. The reference electrode 206 may, for example, be a saturated Calomel reference electrode (SCE), a silver electrode saturated with silver chloride, or a platinum electrode. To establish relative motion between the working electrode 202 and the plating solution, a motor 210 may be used to rotate the working electrode 202. Without such motion, the plating solution generally becomes depleted at the surface of the working electrode 202 and the deposition rate obtained may not reflect the correct rate for the plating solution. Other means of obtaining relative motion can be used, such as a pump for moving the plating solution across the face of the working electrode 202.

A computer 212 generally controls an electronic potentiostat 214, which controls the energy input of the working electrode 202 relative to the reference electrode 206. Using a suitable program, specific energy input sequences of the present invention may be applied to the working electrode 202. The output of the device 105 can also be plotted on an X-Y recorder for each step. The following description of embodiments of the invention will be described by reference to the energy input as current and energy output as potential, and will be described by reference to standard acid/copper electroplating solutions. It is possible however to use the method to control other metal solutions such as nickel, chromium, zinc, tin, gold, silver, lead, cadmium, and solder, for example.

Embodiments of the invention generally employ copper plating solutions having copper sulfate at a concentration between about 5 g/L and about 100 g/L, an acid at a concentration between about 5 g/L and about 200 g/L, and halide ions, such as chloride, at a concentration between about 10 ppm and about 200 ppm, for example. The acid may include sulfuric acid, phosphoric acid, and/or derivatives thereof. In addition to copper sulfate, the plating solution may include other copper salts, such as copper fluoborate, copper gluconate, copper sulfamate, copper sulfonate, copper pyrophosphate, copper chloride, or copper cyanide, for example. However, embodiments of the invention are not limited to these parameters.

The electroplating solution may further include one or more additives. Additives, which may be, for example, levelers, inhibitors, suppressors, brighteners, accelerators, or other additives known in the art, are typically organic materials that adsorb onto the surface of the substrate being plated and have an affect on plating characteristics. Useful suppressors typically include polyethers, such as polyethylene, glycol, or other polymers, such as polypropylene oxides, which adsorb on the substrate surface, slowing down copper deposition in the adsorbed areas. Useful accelerators typically include sulfides or disulfides, such as bis (3-sulfopropyl)disulfide, which compete with suppressors for adsorption sites, accelerating copper deposition in adsorbed areas. Useful inhibitors typically include sodium benzoate and sodium sulfite, which inhibit the rate of copper deposition on the substrate. During plating, the additives are consumed at the substrate surface, but are being constantly replenished by the plating solution. However, differences in diffusion rates of the various additives result in different surface concentrations at the top and the bottom of the features, thereby setting up different plating rates in the features. Ideally, these plating rates should be higher at the bottom of the feature for bottom-up fill. Thus, an appropriate composition of additives in the plating solution is required to achieve a void-free fill of the features.

The additive concentrations in the plating solution generally should remain in the low ppm range, e.g., less than 5 ppm, to obtain acceptable deposits. For example, when the accelerator level is insufficient, the copper deposits are burnt and powdery. Excess accelerator induces brittleness and a nonuniform deposition on the substrate surface. Additive concentrations fluctuate as a result of oxidation at the anode, reduction and inclusion at the cathode and chemical reactions. Since the additive concentrations are continually fluctuating within the plating solution, it is necessary to minimize the time between chemical analysis and correction of the additive concentration within the plating solution.

Figure 3:
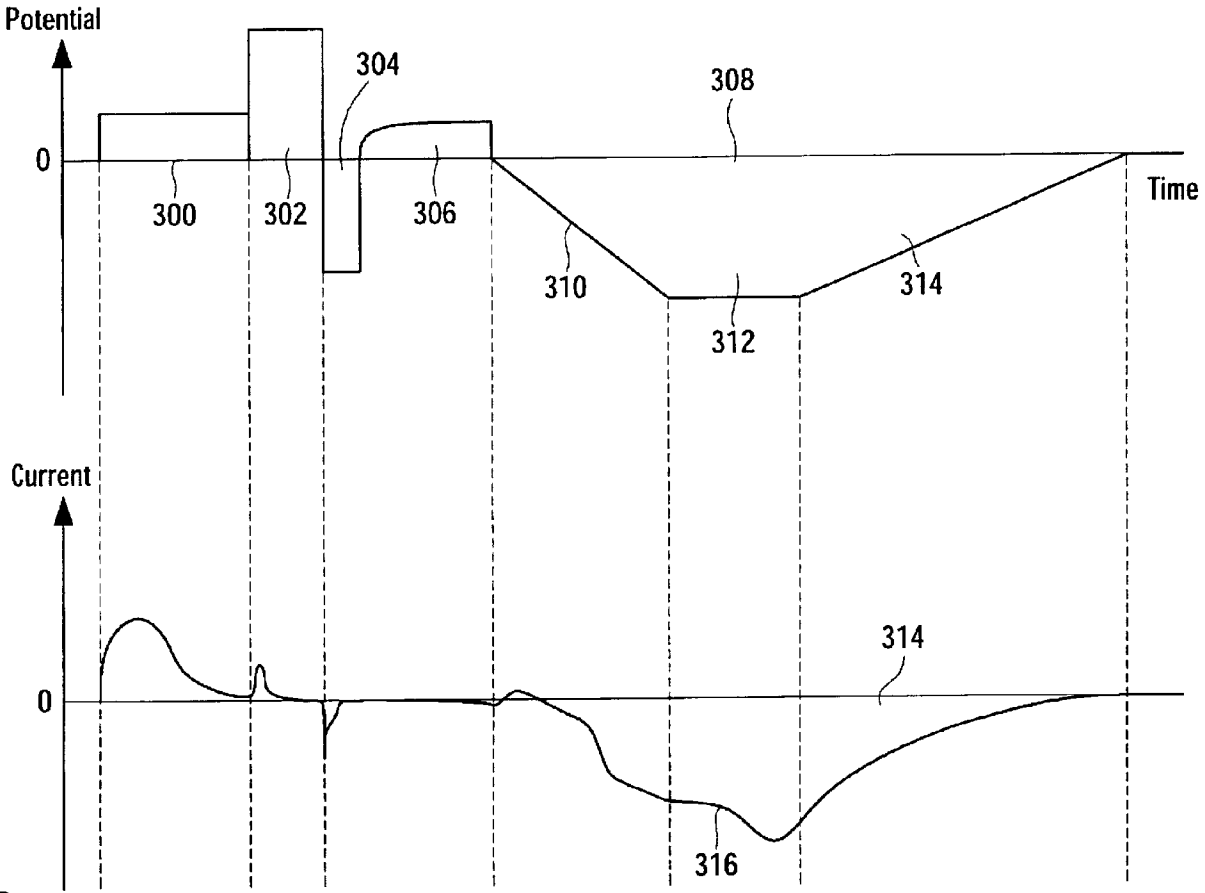
FIG. 3 shows the output of an exemplary embodiment of the invention.

FIG. 3 illustrates a voltage signal for an exemplary embodiment of the invention. Embodiments of the invention include cycling the working electrode 202 through a sequence of steps, including a stripping 300, cleaning 302, pre-plating 304, equilibration 306, and metal deposition step 308. The steps prior to the metal deposition step 308 include several distinct pulses to provide increased additive sensitivity and reproducibility of the results. The metal stripping step 300 includes pulsing the potential between the working electrode 202 and the reference electrode 206 from an initial voltage, for example, from the open circuit potential, to a potential between about 0.2 V and about 0.8 V, i.e., the metal stripping potential, until the corresponding current is approximately 0 mA/cm, for example, about 2 seconds to about 10 seconds. As used herein, the term "pulse" refers to immediately applying a desired potential from a prior potential. Next, the potential is pulsed to about 1.2 V to about 1.6 V, i.e., the cleaning potential, for about 2 seconds to about 10 seconds to clean the working electrode 202 in the cleaning step 302. A thin layer of metal is then plated onto the surface of the working electrode 202 in a pre-plating step 304 by pulsing to a potential between about −0.2 V and about −0.5 V, i.e., the pre-plating potential, for about 2 seconds to about 10 seconds. The potential is then pulsed back to the open circuit potential in an equilibration stage 306 for a predetermined time period, for example, about 10 seconds to about 60 seconds. The final step is a metal deposition step 308. The deposition step 308 includes scanning to an additive sensitive potential 310, i.e., a potential where the additive desorbs from the working electrode, holding the additive sensitive potential 312 for about 1 to about 30 seconds, and reversing the potential and scanning back 314 to the open circuit potential. As used herein, the term "scan" refers to linearly ramping to a desired potential from a prior potential. The additive sensitive potential may vary and is dependent on the additive to be measured.

As a result of linear scanning, the rate of metal deposition is sensitive to the presence and concentration of additives present in the plating solution. Therefore, the amount of electricity spent for metal deposition, $Q_c$, changes depending on the composition of the plating solution. Selection of the proper scan rate, the deposition potential range, and the working electrode rotational speed help to make the $Q_c$ more sensitive to the additive to be analyzed by further reducing the effects of the other constituents in the plating solution. Varying the scan rate separates slow processes from fast process. In addition, the use of various rotational speeds allows for additive transport control. Embodiments of the invention contemplate repeating the above sequence until steady state is reached, i.e., until two sequential values agree within about 2%, for example, between 2 to 5 cycles. The average of the steady state data obtained from the last cycles is generally used to estimate the unknown additive concentration.

The additive concentration is then determined by integrating the current over the metal deposition time period 308, resulting in a deposition charge, and comparing the deposition charge to deposition charges for known plating solutions. Conventional methods measure the additive concentration by integrating the current over the metal stripping time period 300. By integrating the current over the metal deposition time period 308, rather than the stripping step 300, embodiments of the present invention reduce the noise produced by other constituents in the plating solution.

Embodiments of the invention further contemplate an equilibration stage 306, wherein the potential of the working electrode 202 is pulsed to a stable open circuit potential for about 5 seconds to about 10 seconds. The stable open circuit potential is pre-determined by measuring the open circuit potential after about 60 seconds.

Figure 4:
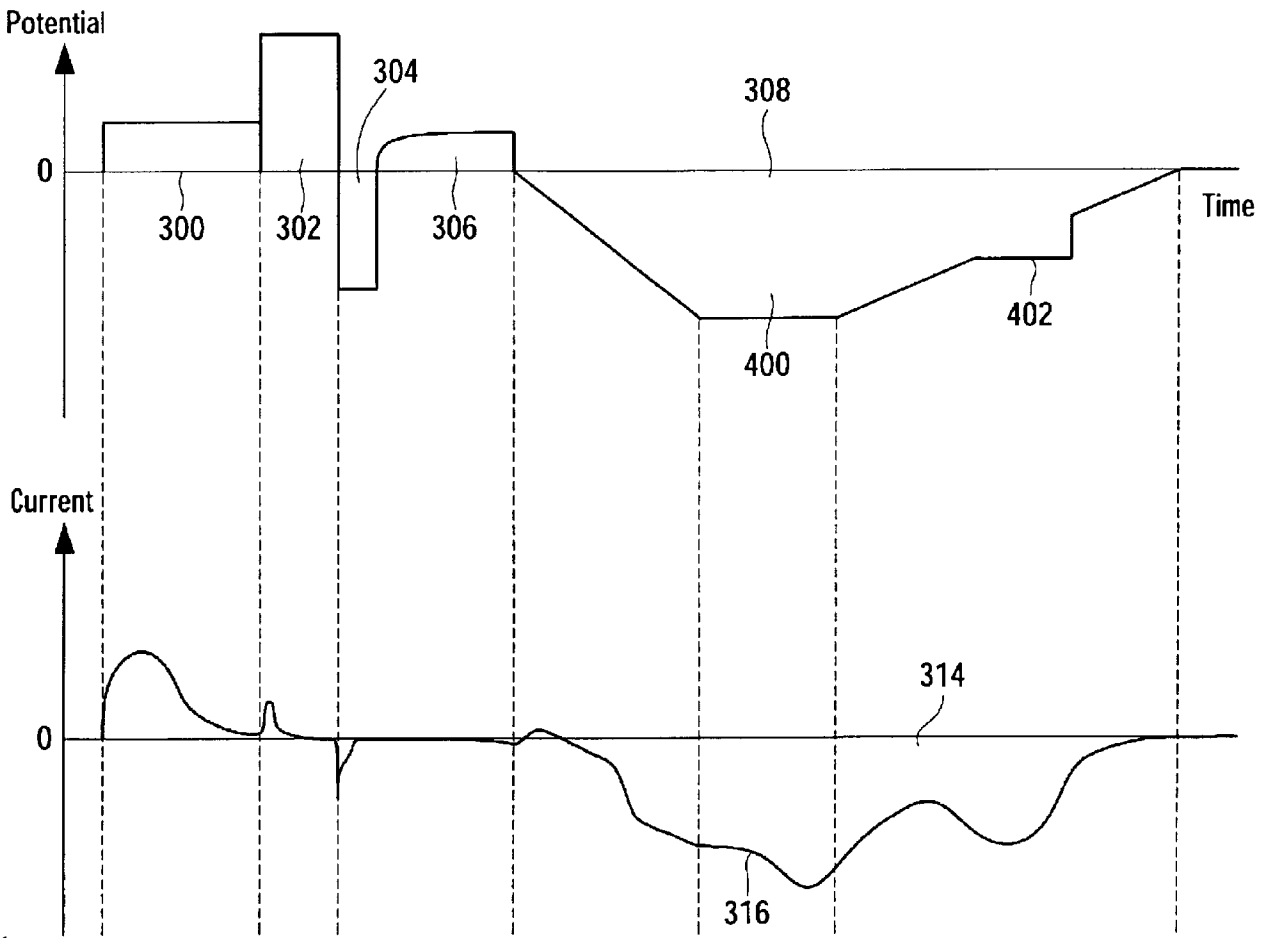
FIG. 4 shows the output of an alternative embodiment of the invention.

FIG. 4 illustrates the output of an alternative embodiment of the invention. Embodiments of the invention further contemplate a metal deposition step 308 including scanning to a potential where the additive desorbs from the working electrode 202, i.e., the additive desorption potential 400, and holding that potential 400 for about 1 second to about 30 seconds so that the additive completely desorbs from the working electrode 202. The potential is then scanned back to a potential where the additive adsorbs onto the working electrode 202 surface, i.e., the additive adsorption potential 402, and is held for about 5 seconds to about 30 seconds. The potential is then scanned back to the open circuit potential.

While the foregoing is directed to embodiments of the present invention, other and further embodiments of the invention may be devised without departing from the basic scope thereof, and the scope thereof is determined by the claims that follow.

What is claimed is:

1. A cyclic voltammetric method for measuring the concentration of additives in a plating solution, comprising:

providing the plating solution, having an unknown concentration of an additive to be measured therein;

cycling the potential of an inert working electrode through a series of measurement steps, comprising:

a metal stripping step including pulsing from an open circuit potential to a metal stripping potential between about 0.2 V and about 0.8 V, and holding the metal stripping potential until a corresponding current is about 0 mA/cm;

a cleaning step including pulsing from the metal stripping potential to a cleaning potential between about 1.2 V and about 1.6 V, and holding the cleaning potential for about 2 seconds to about 10 seconds;

a pre-plating step including pulsing from the cleaning potential to a pre-plating potential between about −0.2 V and about −0.5 V, and holding the pre-plating potential for about 2 seconds to about 10 seconds;

an equilibration step including pulsing from the pre-plating potential to the open circuit potential, and holding the open circuit potential for a predetermined time period; and a metal deposition step including scanning from the open circuit potential of the equilibration step to an additive sensitive potential, holding the additive sensitive potential for about 1 second to about 30 seconds, and scanning back to the open circuit potential; and determining a profile of a deposition current resulting from the metal deposition potential as a function of time and integrating the deposition current to determine the concentration of the additive to be measured.

2. The method of claim 1, wherein the metal stripping step further comprises pulsing for about 2 seconds to about 10 seconds.

3. The method of claim 1, wherein the metal stripping potential is between about 0.4 V to about 0.6 V.

4. The method of claim 1, wherein the series of measurement steps is repeated until a steady state is reached.

5. The method of claim 1, wherein the series of measurement steps is repeated from about 1 to about 5 times.

6. The method of claim 4, wherein the profile of the deposition current when steady state has been reached are averaged to determine the concentration of the additive to be measured.

7. The method of claim 1, wherein the equilibration step further comprises holding the open circuit potential for about 10 seconds to about 60 seconds.

8. The method of claim 1, wherein the open circuit potential of the equilibration step is a stable open circuit potential.

9. The method of claim 8, wherein the stable open circuit potential is held for about 5 seconds to about 10 seconds.

10. The method of claim 1, wherein the metal deposition step further comprises scanning to an additive desorption potential and holding the desorption potential until substantially all of the additive desorbs from the working electrode surface, scanning to an additive adsorption potential and holding the adsorption potential for about 5 seconds to about 30 seconds, and scanning from the additive adsorption potential to the open circuit potential.

11. The method of claim 10, wherein the additive desorption potential is held constant for about 1 second to about 30 seconds.

12. The method of claim 1, further comprising integrating the deposition current over the additive sensitive potential range.

13. A method for measuring the concentration of additives in a plating solution, comprising:

cycling the potential of an inert working electrode through a series of measurement steps, comprising:

a metal stripping step including pulsing from an open circuit potential to a metal stripping potential sufficient to remove substantially all metal on the working electrode, and holding the metal stripping potential until a corresponding current nears 0 mA/cm;

a cleaning step including pulsing from the metal stripping potential to a cleaning potential, and holding the cleaning potential for about 2 seconds to about 10 seconds;

a pre-plating step including pulsing from the cleaning potential to a pre-plating potential sufficient to plate a layer of metal on the working electrode, and holding the pre-plating potential for about 2 seconds to about 10 seconds;

an equilibration step including pulsing from the pre-plating potential to the open circuit potential, and holding the open circuit potential for a predetermined time period; and a metal deposition step including scanning from the open circuit potential of the equilibration step to an additive sensitive potential, holding the additive sensitive potential for about 1 second to about 30 seconds, and scanning back to the open circuit potential; and determining a profile of a deposition current resulting from the metal deposition potential as a function of time and integrating the deposition current to determine the concentration of the additive to be measured.

14. The method of claim 13, wherein the metal stripping step further includes pulsing to a metal stripping potential between about 0.2 V and about 0.8 V and holding the metal stripping potential for about 2 seconds to about 10 seconds.

15. The method of claim 13, wherein the metal stripping step includes pulsing to a potential between about 0.4 V to about 0.6 V.

16. The method of claim 13, wherein the cleaning potential is between about 1.2 V and about 1.6 V.

17. The method of claim 13, wherein the pre-plating potential is between about −0.2 V and about −0.5 V.

18. The method of claim 13, wherein the series of measurement steps is repeated until a steady state is reached.

19. The method of claim 13, wherein the series of measurement steps is repeated from about 1 to about 5 times.

20. The method of claim 19, wherein the profiles from the deposition charges when steady state has been reached are averaged to determine the concentration of the additive to be measured.

21. The method of claim 13, wherein the equilibration step comprises leaving the potential at the open circuit potential for about 10 seconds to about 60 seconds.

22. The method of claim 13, wherein the equilibration step comprises pulsing the potential to a stable open circuit potential for about 5 seconds to about 10 seconds.

23. The method of claim 13, wherein the metal deposition step further comprises scanning to an additive desorption potential and holding the desorption potential until substantially all of the additive desorbs from the working electrode surface, scanning to an additive adsorption potential and holding the adsorption potential for about 5 seconds to about 30 seconds, and scanning from the additive adsorption potential to the open circuit potential.

24. The method of claim 23, wherein the additive desorption potential is held for about 1 second to about 30 seconds.

25. The method of claim 13, further comprising integrating the deposition current over the additive sensitive potential range.

26. A cyclic voltammetric method for measuring the concentration of additives in a plating solution, comprising:

cycling the potential of an inert working electrode through a series of measurement steps, comprising:

a metal stripping step including pulsing from an open circuit potential to a metal stripping potential between about 0.4 V and about 0.6 V, and holding the metal stripping potential for about 2 seconds to about 10 seconds;

a cleaning step including pulsing from the metal stripping potential to a cleaning potential between about 1.2 V and about 1.6 V, and holding the cleaning potential for about 2 seconds to about 10 seconds;

a pre-plating step including pulsing from the cleaning potential to a pre-plating potential between about −0.2 V and about −0.5 V, and holding the pre-plating potential for about 2 seconds to about 10 seconds;

an equilibration step including pulsing from the pre-plating potential to the open circuit potential, and holding the open circuit potential for about 10 seconds to about 60 seconds; and a metal deposition step including scanning from the open circuit potential of the equilibration step to an additive sensitive potential, holding the additive sensitive potential for about 1 second to about 30 seconds, and scanning back to the open circuit potential;

repeating the series of measurement steps until a steady state is reached;

determining a profile of a deposition current resulting from the metal deposition potential as a function of time and integrating the deposition current to determine the concentration of the additive to be measured; and averaging the deposition currents from the series of measurement steps when steady state has been reached to determine the concentration of the additive to be measured.

27. A cyclic voltammetric method for measuring the concentration of additives in a plating solution, comprising:

providing the plating solution, having an unknown concentration of an additive to be measured therein;

cycling the potential of an inert working electrode through a series of measurement steps, comprising:

a metal stripping step including pulsing from an open circuit potential to a metal stripping potential between about 0.4 V and about 0.6 V, and holding the metal stripping potential for about 2 seconds to about 10 seconds;

a cleaning step including pulsing from the metal stripping potential to a cleaning potential between about 1.2 V and about 1.6 V, and holding the cleaning potential for about 2 seconds to about 10 seconds;

a pre-plating step including pulsing from the cleaning potential to a pre-plating potential between about −0.2 V and about −0.5 V, and holding the pre-plating potential for about 2 seconds to about 10 seconds;

an equilibration step including pulsing from the pre-plating potential to the open circuit potential, and holding the open circuit potential for about 10 seconds to about 60 seconds; and a metal deposition step including scanning from the open circuit potential of the equilibration step to an additive desorption potential, and holding the desorption potential for about 1 second to about 30 seconds, scanning to an additive adsorption potential and holding the adsorption potential for about 5 seconds to about 30 seconds, and scanning from the additive adsorption potential to the open circuit potential;

repeating the series of measurement steps until a steady state is reached;

determining a profile of a deposition current resulting from the metal deposition potential as a function of time, and integrating the deposition current over the additive desorption potential to determine the concentration of the additive to be measured; and averaging the deposition currents from the series of measurement steps when steady state has been reached to determine the concentration of the additive to be measured.

28. A cyclic voltammetric method for measuring the concentration of additives in a plating solution, comprising:

cycling the potential of a working electrode through a series of measurement steps, comprising a metal stripping step, a cleaning step, a pre-plating step, an equilibration step, and a metal deposition step; and determining a profile of a deposition current resulting from the metal deposition potential as a function of time and integrating the deposition current to determine the concentration of the additive to be measured.

29. The method of claim 28, wherein the metal stripping step further comprises pulsing from an open circuit potential to a metal stripping potential between about 0.2 V and about 0.8 V, and holding the metal stripping potential until a corresponding current is about 0 mA/cm.

30. The method of claim 29, wherein the metal stripping step further comprises holding the metal stripping potential for about 2 seconds to about 10 seconds.

31. The method of claim 29, wherein the metal stripping potential is between about 0.4 V and about 0.6 V.

32. The method of claim 28, wherein the cleaning step further comprises pulsing from a metal stripping potential to a cleaning potential between about 1.2 V and about 1.6 V and holding the cleaning potential for about 2 seconds to about 10 seconds.

33. The method of claim 28, wherein the pre-plating step further comprises pulsing from a cleaning potential to a pre-plating potential between about −0.2 V and about −0.5 V and holding the pre-plating potential for about 2 seconds to about 10 seconds.

34. The method of claim 28, wherein the equilibration step includes pulsing from a pre-plating potential to an open circuit potential, and holding the open circuit potential for about 10 seconds to about 60 seconds.

35. The method of claim 28, wherein the equilibration step includes pulsing from a pre-plating potential to a stable open circuit potential, and holding the open circuit potential for about 5 seconds to about 10 seconds.

36. The method of claim 28, wherein the metal deposition step includes scanning from an open circuit potential of the equilibration step to an additive sensitive potential, holding the additive sensitive potential for about 1 second to about 30 seconds, and scanning back to the open circuit potential.

37. The method of claim 28, wherein the metal deposition step comprises scanning to an additive desorption potential, and holding the desorption potential until substantially all of the additive desorbs from the working electrode surface, scanning to an additive adsorption potential, and holding the adsorption potential for about 5 seconds to about 30 seconds, and scanning from the additive adsorption potential to the open circuit potential.

38. The method of claim 37, wherein the additive desorption potential is held constant for about 1 second to about 30 seconds.

39. The method of claim 28, wherein the series of measurement steps is repeated until a steady state is reached.

40. The method of claim 39, wherein profiles from the deposition charges when steady state has been reached are averaged to determine the concentration of the additive to be measured.

41. The method of claim 28, wherein the series of measurement steps is repeated from about 1 to about 5 times.

42. A cyclic voltammetric method for measuring the concentration of additives in a plating solution, comprising:

cycling the potential of a working electrode through a series of measurement steps, comprising a metal stripping step, a cleaning step, a pre-plating step, an equilibration step, and a metal deposition step, wherein the metal stripping step further comprises pulsing from an open circuit potential to a metal stripping potential between about 0.4 V and about 0.6 V, and holding the metal stripping potential until a corresponding current is about 0 mA/cm; and determining a profile of a deposition current resulting from the metal deposition potential as a function of time and integrating the deposition current to determine the concentration of the additive to be measured.

43. A cyclic voltammetric method for measuring the concentration of additives in a plating solution, comprising:

cycling the potential of a working electrode through a series of measurement steps, comprising a metal stripping step, a cleaning step, a pre-plating step, an equilibration step, and a metal deposition step, wherein the metal deposition step includes scanning from an open circuit potential of the equilibration step to an additive sensitive potential, holding the additive sensitive potential for about 1 second to about 30 seconds, and scanning back to the open circuit potential; and determining a profile of a deposition current resulting from the metal deposition potential as a function of time and integrating the deposition current to determine the concentration of the additive to be measured.

44. A cyclic voltammetric method for measuring the concentration of additives in a plating solution, comprising:

cycling the potential of a working electrode through a series of measurement steps, comprising a metal stripping step, a cleaning step, a pre-plating step, an equilibration step, and a metal deposition step, wherein the metal deposition step comprises scanning to an additive desorption potential, and holding the desorption potential until substantially all of the additive desorbs from the working electrode surface, scanning to an additive adsorption potential, and holding the adsorption potential for about 5 seconds to about 30 seconds, and scanning from the additive adsorption potential to the open circuit potential; and determining a profile of a deposition current resulting from the metal deposition potential as a function of time and integrating the deposition current to determine the concentration of the additive to be measured.

45. The method of claim 44, wherein the additive desorption potential is held constant for about 1 second to about 30 seconds.

46. A cyclic voltammetric method for measuring the concentration of additives in a plating solution, comprising:

cycling the potential of a working electrode through a series of measurement steps, comprising a metal stripping step, a cleaning step, a pre-plating step, an equilibration step, and a metal deposition step; and determining a profile of a deposition current resulting from the metal deposition potential as a function of time and integrating the deposition current to determine the concentration of the additive to be measured, wherein the series of measurement steps is repeated until a steady state is reached and profiles from the deposition charges are averaged when the steady state has been reached.

* * * * *